US006228218B1

(12) United States Patent
Takeuchi et al.

(10) Patent No.: US 6,228,218 B1
(45) Date of Patent: May 8, 2001

(54) WATER-DISINTEGRATABLE CLEANING SHEET CONTAINING ALKYLCELLULOSE

(75) Inventors: Naohito Takeuchi; Takayoshi Konishi, both of Kagawa; Ryuichiro Kurata, Tokyo; Nobuo Morohashi, Tokyo; Masayoshi Matsumoto, Tokyo, all of (JP)

(73) Assignee: Uni-Charm Corporation, Ehime (JP)

( * ) Notice: Subject to any disclaimer, the term of this patent is extended or adjusted under 35 U.S.C. 154(b) by 0 days.

(21) Appl. No.: 09/220,435

(22) Filed: Dec. 24, 1998

(30) Foreign Application Priority Data

Dec. 26, 1997 (JP) ..... 9-360432

(51) Int. Cl.[7] ..... D21F 11/00

(52) U.S. Cl. ..... 162/158; 162/168.1; 162/175; 162/177; 162/181.2; 162/179; 162/168.2; 162/135; 162/157.6; 162/146

(58) Field of Search ..... 162/158, 168.1, 162/175, 177, 181.2, 179, 168.2, 135, 157.6, 146

(56) References Cited

U.S. PATENT DOCUMENTS 5,281,306 * 1/1994 Kakiuchi ..... 162/158

FOREIGN PATENT DOCUMENTS

| | | |
|---|---|---|
| 002134389 | 4/1994 | (GB) . |
| 3-72388 | 6/1990 | (JP) . |
| 3-292924 | 12/1991 | (JP) . |
| 6-198778 | 7/1994 | (JP) . |
| 7-24636 | 3/1995 | (JP) . |
| 9-170193 | 6/1997 | (JP) . |
| 94/11432 | 5/1994 | (WO) . |

* cited by examiner

*Primary Examiner*—Peter Chin
*Assistant Examiner*—Mark Halpern
(74) *Attorney, Agent, or Firm*—Darby & Darby

(57) ABSTRACT

A water-disintegratable cleaning sheet consisting of a fibrous sheet having incorporated thereinto, a binder of alkylcellulose; an electrolyte, and (a) a copolymer of a polymerizable acid anhydride and other compounds and/or (b) an amino acid. The water-disintegratable cleaning sheet has excellent water disintegratability and wet strength and further it is not degraded in the water disintegratability and wet strength after storage at high temperatures.

5 Claims, No Drawings

WATER-DISINTEGRATABLE CLEANING SHEET CONTAINING ALKYLCELLULOSE

BACKGROUND OF THE INVENTION

1. Field of the Invention

The present invention concerns a water-disintegratable cleaning sheet easily dispersible by water streams. More specifically, it relates to a water-disintegratable cleaning sheet having excellent water disintegratability, wet strength and stability.

2. Related Art Statement

Cleaning sheets are used for wiping human skins such as of hips or for cleaning toilet articles. The cleaning sheets are preferably water-disintegratable so that they can be thrown away to toilets after use. When they are thrown away into a toilet, it would take much time to disperse them in a septic tank unless they are satisfactorily water-disintegratable, and they sometimes clog drainages of the toilet.

Disposable cleaning sheets to be used for wiping are usually marketed while being packaged in a state previously wetted with liquid cleaning medicals in view of convenience and handlability. However, such cleaning sheets must have wet strength sufficient to endure wiping in a state impregnated with liquid cleaning medicals, and are required to be water-disintegratable when thrown away to toilets.

Japanese Patent Publication Hei 7-24636, for example, discloses a water-disintegratable cleaning article comprising a water soluble binder having carboxyl groups, metal ions and an organic solvent. However, the metal ions and the organic solvent are stimulative to skins.

Japanese Patent Laid-Open Hei 3-292924 discloses a water-disintegratable cleaning article comprising fibers containing polyvinyl alcohol and impregnated with an aqueous boric acid solution, and Japanese Patent Laid-Open Hei 6-198778 discloses a water-disintegratable napkin comprising a polyvinylalcohol-containing non-woven fabric incorporated with borate ions and bicarbonate ions. However, polyvinyl alcohol is sensitive to heat, and the wet strength of water-disintegratable articles and water-disintegratable napkins is lowered at 40° C. or higher.

In addition, Japanese Patent Laid-Open Hei 9-170193 discloses a water-disintegratable sheet coated with a water soluble cellulose ether and incorporated with an electrolyte. However, fibrous sheets having more excellent water disintegratability and wet strength have been required.

An object of the present invention is to provide a cleaning sheet having satisfactory water disintegratability, as well as having wet strength so as to be endurable during use in a wet state.

Another object of the present invention is to provide a cleaning sheet of excellent stability not suffering from deterioration of water disintegratability and wet strength even when stored for long time at high temperature in a wet state.

SUMMARY OF THE INVENTION

The foregoing object can be attained according to the present invention by a water-disintegratable cleaning sheet comprising:

a fibrous sheet comprising water-dispersible fibers, having incorporated thereinto, a binder comprising an alkylcellulose; and an electrolyte, and at least one compound selected from the group consisting of:

a) copolymers of the polymerizable acid anhydride compounds and other compounds and b) amino acid derivatives.

The water-disintegratable cleaning sheet of the present invention can keep sufficient wet strength during wiping even in a wet state incorporated with water. Since it is disintegrated easily when immersed in a large quantity of water after use, it can be thrown away to toilets. In addition, the water-disintegratable cleaning sheet of the present invention is not degraded in the water disintegratability and wet strength even during storage at high temperatures of about 40° C.

In the present invention, a water-disintegratable cleaning sheet highly safe to human bodies can be obtained by selecting the kind of the copolymer incorporated in the fibrous sheet.

In the present invention, the copolymer is preferably a partially sponified alkali metal salt.

In the present invention, the alkyl cellulose is preferably methylcellulose. The content of the alkylcellulose is preferably from 1 to 30 g based on 100 g of the fibers.

In the present invention, the copolymer is preferably at least one compound selected from the group consisting of (meth)acrylic acid(ester)-maleic acid copolymer and (meth) acrylic acid(ester)-fumaric acid copolymer. In this case, it is preferable that the fibrous sheet is impregnated with an aqueous solution of the copolymer at a concentration of from 0.05 to 5.0% by weight to obtain the cleaning sheet.

In the present invention, the amino acid derivative is preferably trimethyl glycine. In this case, it is preferred that the fibrous sheet is impregnated with an aqueous solution of the amino acid derivative at a concentration of from 5 to 15% by weight to obtain the cleaning sheet.

In the present invention, it is preferred that both of the copolymer and the amino acid derivative are dissolved in water, and the fibrous sheet is impregnated with the aqueous solution to obtain the cleaning sheet. In this case, the concentration of the amino acid derivative of the aqueous solution is preferably from 1 to 5% by weight.

In the present invention, the electrolyte is preferably sodium sulfate. The fibrous sheet is preferably impregnated with the electrolyte while being dissolved in an aqueous solution in which the copolymer and/or the amino acid derivative are dissolved. In this case, the concentration of the aqueous solution is preferably from 0.5 to 10% by weight.

In the present invention, preferably, the fibers are made of pulp of conifer, and the basis weight of the fibrous sheet is from 30 to 70 g/m$^2$.

The cleaning sheet of the present invention is preferably used in a wet state incorporated with water.

PREFERRED EMBODIMENT OF THE INVENTION

As fibers of the fibrous sheet in the cleaning sheet of the present invention, fibers having satisfactory dispersibility in water, namely, water dispersible fibers are preferably used. The dispersibility in water in this case has the same meaning as water disintegratability, and is such a characteristic that fibers are disintegrated upon contact with a large quantity of water.

As the fibers to be used in the present invention, either or both of natural and chemical fibers may be used. The natural fibers can include, for example, wooden pulp such as pulp of conifer and pulp of hardwood, and chemical fibers can include rayon as regenerated fibers and polypropylene as synthetic fibers. In addition, there can also be adopted those fibers mainly comprising the above-mentioned fibers and incorporated with natural fibers such as cotton, synthetic fibers such as rayon, polypropylene, polyvinyl alcohol, polyester or polyacrylonitrile and inorganic fibers such as synthetic pulp comprising polyethylene and glass wool. Among them, bleached kraft pulp of conifer and bleached kraft pulp of hardwood are especially preferred since they have high water dispersibility.

In the present invention, the basis weight of the fibers is preferably from 20 to 100 g/m$^2$. If the basis weight is less than the lower limit, wet strength required when the cleaning sheet is used for wiping in a wet state can not be obtained. If the basis weight is greater than the upper limit, the cleaning sheet lacks in flexibility. The basis weight of the fibers, when used relative to human skins, is more preferably from 30 to 70 g/m$^2$ with respect to the wet strength and soft feeling.

The fibrous sheet according to the present invention can be produced by using any of dry and wet type process ordinarily adopted. The fibrous sheet mentioned herein comprises fibers formed into a sheet to which a binder is applied. For example, when it is produced by a wet process, a fiber web obtained by paper making is dried, to which an alkylcellulose is applied as a binder by using silk screen and the like. The fiber web is a mass of fibers in the form of a sheet in which the direction of the fibers is aligned to some extent.

Alkylcellulose is a compound in which hydroxyl groups in an glucose ring unit of cellulose are substituted with alkyl groups. The alkylcellulose can include, for example, methylcellulose, ethylcellulose and benzylcellulose. Among them, methylcellulose is especially preferred with respect to satisfactory water disintegratability and wet strength of the cleaning sheet. The amount of alkylcellulose (coating amount) is preferably from 1 to 30 g based on 100 g of the weight of the fibers. If the amount is less than the lower limit, the wet strength of the cleaning sheet is lowered. On the other hand, if the amount is greater than the upper limit, the cleaning sheet is hardened to degrade soft feeling. In addition, the water disintegratability is also lowered.

The fibrous sheet thus obtained is incorporated with an electrolyte, and further incorporated with (a) a copolymer of a polymerizable acid anhydride compound and other compounds and/or (b) an amino acid derivative, to obtain a water-disintegratable cleaning sheet having excellent water disintegratability and wet strength.

As the electrolyte, either or both of organic and inorganic salts can be used. The inorganic salts can include, for example, sodium sulfate, potassium sulfate, zinc sulfate, zinc nitrate, potassium alum, sodium chloride, aluminum sulfate, magnesium sulfate, potassium chloride, sodium carbonate, sodium hydrogen carbonate and ammonium carbonate. Among them, monovalent inorganic salts are preferred since they enhance the wet strength of the cleaning sheet. In addition, sodium sulfate, among them, is especially preferred since it further enhances the wet strength of the cleaning sheet. Organic salts can include, for example, sodium pyrrolidone carboxylate, sodium citrate, potassium citrate, sodium tartarate, potassium tartarate, sodium lactate, sodium succinate, calcium pantothenate, calcium lactate and sodium lauryl sulfate. Among them, monovalent organic salts are preferred since they increase the wet strength of the cleaning sheet.

In order to incorporate the electrolyte in the fibrous sheet, it is a convenient step to dissolve the electrolyte together with other compounds in water, and impregnate the fibrous sheet with the aqueous solution. Accordingly, the electrolyte is preferably water soluble. In this case, the concentration of the electrolyte in the aqueous solution for impregnating the fibrous sheet is preferably from 0.5 to 10% by weight, more preferably, from 1.0 to 5.0% by weight. If the content of the electrolyte is lower, it is difficult to obtain wet strength required for the cleaning sheet. As the content of the electrolyte is increased, the wet strength of the cleaning sheet is increased. However, when using sodium sulfate as the electrolyte and using the cleaning sheet relative to human skins, the content of sodium sulfate is preferably reduced in order not to be stimulative to skins. As a method of impregnating the fibrous sheet with an aqueous solution containing the electrolyte can include immersion and spraying.

(a) the copolymer of the polymerizable acid anhydride compound and other compounds can include, for example, a compound formed by copolymerizing maleic acid anhydride or fumaric acid anhydride as the acid anhydride with methyl methacrylate, methyl acrylate, ethyl acrylate, ethyl methacrylate or butyl methacrylate. When a cleaning sheet is used directly on human skins, preferred copolymers can include, for example, (meth)acrylic acid-maleic acid type resin, (meth)acrylic acid-fumaric acid type resin, vinyl acetate-maleic acid resin, rosin-modified fumaric acid resin, methylvinylether-maleic acid resin, a-olefin maleic acid resin, a-olefin fumaric acid resin, isobutylene-maleic acid resin and pentene-maleic acid resin. In addition, when the cleaning sheet is used not directly to human skins, there can be used those resins containing hydroxyl groups such as urea formaldehyde resin, methylol melamine resin, and organic compounds containing two or more hydroxy groups such as glyoxal and tannic acid, and epoxypolyamide type resins. Among those copolymers, (meth)acrylic acid(ester)-maleic acid copolymer and/or (meth)acrylic acid(ester)-fumaric acid copolymer are preferred since they have high safety and enhance the wet strength of the cleaning sheet.

Those copolymers are preferably reacted with alkali metal hydroxides such as sodium hydroxide and potassium hydroxide to saponify into partial sodium salt of carboxylic acid. The saponification degree is preferably from 0.1 to 1.0. Since the partially sapofinified copolymer has adjacent carboxylic acid groups which form salts, it tends to be dissolved in water. It is preferable that the copolymer is water soluble, since it can be dissolved in water when it is impregnated in the fibrous sheet. And then, it is convenient to obtain the cleaning sheet containing the copolymer. In addition, the water disintegratability of the cleaning sheet can be improved by using the water soluble copolymer compared with a case of using less water soluble copolymer. In addition, when the copolymer is incorporated being dissolved in an aqueous solution into the fibrous sheet, the concentration of the copolymer in the aqueous solution is preferably from 0.05 to 5.0% by weight. Even if the amount of the copolymer is increased to more than the upper limit, the wet strength of the cleaning sheet does not change so much, so that the amount of the copolymer is preferably less than the upper limit in view of the cost. In addition, when it is used directly to human skins, the content of the copolymer preferably is not so great in order not to give stimulation to skins. If the concentration of the copolymer is less than 0.05% by weight, it is difficult to obtain wet strength required for the cleaning sheet. However, the wet strength of the cleaning sheet can be increased by incorporating the amino acid derivative instead of or together with a slight amount of the copolymer in the fibrous sheet.

(b) The amino acid derivative is a compound obtained from amino acids and can include, for example, amino acids subjected to acylation, dehydrating condensation or esterification, and fatty acids subjected to neutralization or polymerization. For example, there can be mentioned trimethyl glycine as an N-trialkyl substituent of glutamic acid, DL-pyrrolidone carboxylic acid, sodium DL-pyrrolidone carboxylate and triethanol amine DL-pyrrolidone carboxylate formed by dehydrating condensation of glutamic acid, N-aminofatty acid amyl L-arginine ethyl-DL-pyrrolidone carboxylate formed by acylating and esterifying arginine, sodium polyaspartate formed by polymerizing aspartic acid. Among them, trimethyl glycine is especially preferred since it has high safety, and can enhance the wet strength of the cleaning sheet.

In order to incorporate the amino acid derivative in the fibrous sheet, the amino acid derivative is dissolved in water together with other compounds since it is water soluble, and the fibrous sheet is impregnated with the aqueous solution. In this case, the concentration of the water soluble amino acid derivative to be impregnated in the fibrous sheet is preferably from 1 to 15% by weight. If the amount of the amino acid derivative relative to the fibrous sheet is excessive, the cleaning sheet becomes slimy to worsen the feeling upon touch. When the fibrous sheet does not contain the copolymer, the concentration of the amino acid derivative in the aqueous solution to be impregnated in the fibrous sheet is preferably 5% by weight or more. If the concentration is lowered than the level, wet strength required for the cleaning sheet can not be obtained. When the fibrous sheet contains the copolymer, the concentration of the amino acid derivative in the aqueous solution impregnated in the fibrous sheet is preferably from 1 to 5% by weight. Since the wet strength of the cleaning sheet is improved by incorporation of the copolymer, required wet strength can be obtained even if the amount of the amino acid derivative is small relative to the fibrous sheet.

The thus obtained water-disintegratable cleaning sheet is not degraded in the water disintegratability or wet strength during storage even at temperatures higher than normal temperature, for example, in an atmosphere at 40° C.

The water-disintegratable cleaning sheet of the present invention preferably contains a polyhydric alcohol such as glycerin, since the wet strength of the cleaning sheet is improved. The water-disintegratable cleaning sheet of the present invention can be incorporated with other materials so long as they do not inhibit the effect of the present invention. For example, surfactants, antibacterial agents, preservatives, deodorants, humectants and alcohols may be incorporated.

Since the water-disintegratable cleaning sheet of the present invention has excellent water disintegratability and wet strength, it can be used as wet tissues for human skins such as of hips or used as cleaning sheets for toilet articles. When the water-disintegratable cleaning sheet of the present invention is packaged as an article previously moistened with cleaning liquid, it is sold while being sealed so that the fibrous sheet is not dried.

Alternatively, the water-disintegratable cleaning sheet of the present invention may be sold in a dried state. For example, a fibrous sheet after coating the alkylcellulose is impregnated with an aqueous solution containing the electrolyte, the copolymer and the amino acid derivative dissolved therein and then dried, and the obtained water-disintegratable cleaning sheet may be used while being impregnated with water or a liquid medical when used.

EXAMPLE

The present invention will be explained more specifically by way of examples but the invention is not restricted to such examples.

Example 1

Bleached kraft pulp of conifer (Canadian standard freeness (CSF)=740 ml) 100% was used as starting fibers and paper of 50 g/m$^2$ basis weight was manufactured by a wet paper making process using a paper making machine (cylinder net). After drying the paper, methyl cellulose was uniformly coated at 2.0 g/m$^2$ to the surface. A silk screen (60 mesh) was used as a coating method. After the coating, drying was conducted at 150° C. for 2 min by using a hot blow type blower to obtain a fibrous sheet.

An aqueous solution of sodium sulfate and a partial sodium salt of a methacrylic acid-maleic acid copolymer each at a content shown in Table 1 was prepared by properly adding ion exchanged water. In this case, the partial sodium salt of the methacrylic acid-maleic acid copolymer was obtained by partially saponifying a methacrylic acid-maleic acid copolymer by using sodium hydroxide. 100 g weight of the fibrous sheet obtained by the process described above was impregnated with 250 g of the aqueous solution, to obtain a water-disintegratable cleaning sheet. Tests for water disintegratability and wet strength were conducted for the water-disintegratable cleaning sheet as an example of the present invention. Further, as a comparative example, the same fibrous sheets as in example was impregnated with an aqueous solution not containing sodium sulfate and partial sodium salt of methacrylic acid-maleic acid copolymer and the tests for water disintegratability and wet strength were conducted to the thus obtained cleaning sheet in the same manner as in the example.

The test for the water disintegratability was conducted by the toilet paper disintegratability test according to JIS P 4501. Referring more specifically, a water-disintegratable cleaning sheet cut into 10 cm length and 10 cm width was charged in a 300 mm volume beaker containing 300 ml of ion exchanged water, and stirred by using a rotor. The number of rotation was at 600 rpm. The dispersed state of the cleaning sheet was observed along with time, and a time required for the dispersion was measured (shown in tables: on the basis of second).

The wet strength was measured by using a cleaning sheet obtained by the method described above and cut into 25 mm width and 150 mm length as a specimen and using a tensilon tester with a chuck distance of 100 mm and at a tensile speed of 100 mm/min. Measurement was conducted in the machine direction (MD) of the paper and the cross direction (CD) of the paper respectively. The strength (gf) at break upon measurement was determined as a value for the result of the wet strength test (shown in tables: on the basis of g/25 mm). Results are shown in Table 1.

TABLE 1

| | Comp. Example | Example 1 | Example 2 | Example 3 |
|---|---|---|---|---|
| Amount of fiber (g/m$^2$) | 50 | 50 | 50 | 50 |
| Coating amount of methylcellulose (g/m$^2$) | 2.0 | 2.0 | 2.0 | 2.0 |
| Copolymer *1 (wt %) | — | 0.05 | 1.0 | 5.0 |
| Sodium sulfate (wt %) | 3.0 | 3.0 | 3.0 | 3.0 |
| Wet strength:MD (g/25 mm) | 670 | 750 | 1080 | 1220 |
| Wet strength:CD (g/25 mm) | 144 | 160 | 228 | 253 |
| Water disintegratability (sec) | 17 | 19 | 41 | 53 |

*1 Partial sodium salt of (meth)acrylic acid(ester)-maleic acid copolymer

Example 2

A fibrous sheet was prepared by the same procedures as in Example 1. An aqueous solution of sodium sulfate and trimethyl glycine each at a content shown in Table 2 was prepared by properly adding ion exchanged water. 100 g weight of the fibrous sheet was impregnated with 250 g of the aqueous solution. Water disintegratability and wet strength were measured for the thus obtained water-disintegratable cleaning sheet. The measuring method was identical with that in Example 1. Further, as a comparative example, the same fibrous sheet as in Example was impregnated with an aqueous solution not containing trimethyl glycine. Tests for water disintegatability and wet strength were conducted in the same manner as in Example to the thus obtained cleaning sheet.

Results are shown in Table 2.

TABLE 2

| | Comp. Example | Example 4 | Example 5 | Example 6 |
|---|---|---|---|---|
| Amount of fiber (g/m$^2$) | 50 | 50 | 50 | 50 |
| Coating amount of methylcellulose (g/m$^2$) | 2.0 | 2.0 | 2.0 | 2.0 |
| Trimethyl glycine (wt %) | — | 1.0 | 4.0 | 10.0 |
| Sodium sulfate (wt %) | 3.0 | 3.0 | 3.0 | 3.0 |
| Wet strength:MD (g/25 mm) | 103 | 275 | 670 | 1630 |
| Wet strength:CD (g/25 mm) | 22 | 48 | 144 | 350 |
| Water disintegratability (sec) | 10 | 11 | 17 | 25 |

Example 3

A fibrous sheet was prepared by the same procedures as in Example 1. An aqueous solution of sodium sulfate and trimethyl glycine and glycerin each at a content shown in Table 3 was prepared by properly adding ion exchanged water. 100 g weight of the fibrous sheet was impregnated with 250 g of the aqueous solution. Water disintegratability and wet strength were measured for the thus obtained water-disintegratable cleaning sheet. The measuring method was identical with that in Example 1. Further, as a comparative example, tests for water disintegatability and wet strength were conducted in the same manner as in the example to the cleaning sheet obtained by impregnating an aqueous solution not containing trimethyl glycine into the same fibrous sheet as in example.

The results are shown in Table 3

TABLE 3

| | Comp.Example | Comp.Example | Comp.Example | Example 7 | Example 8 |
|---|---|---|---|---|---|
| Amount of fiber (g/m$^2$) | 50 | 50 | 50 | 50 | 50 |
| Coating amount of methylcellulose (g/m$^2$) | 2.0 | 2.0 | 2.0 | 2.0 | 2.0 |
| Trimethyl glycine (wt %) | — | — | — | 5.0 | 5.0 |
| Sodium sulfate (wt %) | 3.0 | 3.0 | 3.0 | 3.0 | 3.0 |
| Glycerin (wt %) | — | 7.0 | 7.0 | 7.0 | — |
| Propylene glycol (wt %) | 7.0 | — | 5.0 | — | — |
| Wet strength:MD (g/25 mm) | 189 | 226 | 291 | 2152 | 1131 |
| Wet strength:CD (g/25 mm) | 61 | 73 | 93 | 480 | 255 |
| Water disintegratability (sec) | 17 | 19 | 19 | 25 | 22 |

Example 4

A fibrous sheet was prepared by the same procedures as in Example 1. An aqueous solution of sodium sulfate, trimethyl glycine and glycerin each at a content shown in Table 4 was prepared by properly adding ion exchanged water. 100 g weight of the fibrous sheet was impregnated with 250 g of the aqueous solution. Water disintegratability and wet strength were measured for the thus obtained water-disintegratable cleaning sheet. The measuring method was identical with that in Example 1. Further, as a comparative example, tests for water disintegatability and wet strength test were conducted in the same manner as in Example to the cleaning sheet obtained by impregnating an aqueous solution not containing sodium sulfate into the same fibrous sheet as in Example.

The results are shown in Table 4.

TABLE 4

| | Comp. Example | Example 9 | Example 10 | Example 11 |
|---|---|---|---|---|
| Amount of fiber (g/m$^2$) | 50 | 50 | 50 | 50 |
| Coating amount of methylcellulose (g/m$^2$) | 2.0 | 2.0 | 2.0 | 2.0 |
| Trimethyl glycine (wt %) | 4.0 | 4.0 | 4.0 | 4.0 |
| Sodium sulfate (wt %) | — | 1.0 | 5.0 | 10.0 |
| Glycerin (wt %) | 7.0 | 7.0 | 7.0 | 7.0 |
| Wet strength:MD (g/25 mm) | 65 | 147 | 3352 | 8235 |
| Wet strength:CD (g/25 mm) | 25 | 48 | 591 | 1728 |
| Water disintegratability (sec) | 11 | 13 | 22 | 38 |

Example 5

A fibrous sheet was prepared by the same procedures as in Example 1. An aqueous solution of sodium sulfate, a partial sodium salt of a methacrylic acid-maleic acid copolymer and trimethyl glycine each at a content shown in Table 5 was prepared by properly adding ion exchanged water. 100 g weight of the fibrous sheet was impregnated with 250 g of the aqueous solution. Water disintegratability and wet strength were measured for the thus obtained water-disintegratable cleaning sheet. The measuring method was identical with that in Example 1. Further, as a comparative example, tests for water disintegatability and wet strength test were conducted in the same manner as in Example to the cleaning sheet obtained by impregnating an aqueous solution not containing partial sodium salt of methacrylic acid-maleic acid copolymer and trimethyl glycine into the same fibrous sheet as in Example. The results are shown in Table 5.

TABLE 5

| | Comp. Example | Example 12 | Example 13 |
|---|---|---|---|
| Amount of fiber (g/m$^2$) | 50 | 50 | 50 |
| Coating amount of methylcellulose (g/m$^2$) | 2.0 | 2.0 | 2.0 |
| Copolymer *1 (wt %) | — | 1.0 | 1.0 |
| Trimethyl glycine (wt %) | — | 4.0 | 10.0 |
| Sodium sulfate (wt %) | 3.0 | 3.0 | 3.0 |
| Wet strength:MD (g/25 mm) | 103 | 1080 | 2880 |
| Wet strength:CD (g/25 mm) | 22 | 228 | 608 |
| Water disintegratability (sec) | 10 | 41 | 62 |

*1 Partial sodium salt of (meth)acrylic acid(ester)-maleic acid copolymer

Example 6

A fibrous sheet was prepared by the same procedures as in Example 1. An aqueous solution of sodium sulfate, trimethyl glycine and glycerin each at a content shown in Table 6 was prepared by properly adding ion exchanged water. 100 g weight of the fibrous sheet was impregnated with 250 g of the aqueous solution. Water disintegratability and wet strength were measured for the thus obtained water-disintegratable cleaning sheet. The measuring method was identical with that in Example 1.

For the stability test, after sealing the water-disintegratable cleaning sheet in a polypropylene bag, placing and storing them in a polyethylene vessel in an atmosphere at 40° C. for seven days, the water disintegratability and the wet strength were measured by the same method as in the example.

Further, as a comparative example, a fibrous sheet was obtained by using carboxymethyl cellulose or polyvinyl alcohol instead of methyl cellulose as a binder. An aqueous solution in which an electrolyte and trimethyl glycine were dissolved each in an amount shown in Table 4 was prepared. In the fibrous sheet using carboxymethyl cellulose as the binder, calcium chloride having an effect of enhancing the wet strength in combination with carboxymethyl cellulose was used as the electrolyte. Further, sodium sulfate having an effect of enhancing the wet strength is used as the electrolyte in the fibrous sheet using a polyvinyl alcohol as the binder. 100 g weight of the binder coated sheet was impregnated with 250 g of the aqueous solution. Test for disintegratability and wet strength test were conducted in the same manner as in Example to the thus obtained cleaning sheet.

The results are shown in Table 6.

TABLE 6

| | Comp. Example | Comp. Example | Example 14 |
|---|---|---|---|
| Amount of fiber (g/m$^2$) | 50 | 50 | 50 |
| Kind of Binder | Carboxymethyl cellulose | Polyvinyl alcohol | Methyl cellulose |
| Coating amount of binder (g/m$^2$) | 2.0 | 2.0 | 2.0 |

TABLE 6-continued

| | Comp. Example | Comp. Example | Example 14 |
|---|---|---|---|
| Kind of electrolyte | Calcium chloride | Sodium sulfate | Sodium sulfate |
| Electrolyte (wt %) | 3.0 | 3.0 | 3.0 |
| Trimethyl glycine (wt %) | 4.0 | 4.0 | 4.0 |
| Glycerin (wt %) | 7.0 | 7.0 | 7.0 |
| Wet strength:MD (g/25 mm) | 344 | 751 | 670 |
| Wet strength:CD (g/25 mm) | 98 | 162 | 144 |
| Water disintegratability (sec) | 25 | 90 | 17 |
| After storage of 7 days at 40° C. | | | |
| Wet strength:MD (g/25 mm) | 332 | 330 | 662 |
| Wet strength:CD (g/25 mm) | 94 | 72 | 141 |
| Water disintegratability (sec) | 24 | 204 | 16 |

As can be seen from Table 6, the wet strength in the example is higher than the wet strength of the cleaning sheet using carboxymethyl cellulose as the binder. Further, in the comparative example using polyvinyl alcohol as the binder, the wet strength and the water disintegratability of the cleaning sheet stored at a high temperature are degraded. On the contrary, in the cleaning sheet of the example using methyl cellulose as the binder, a high wet strength can be obtained and the wet strength and the water disintegratability are not changed even during storage at a high temperature.

Example 7

A fibrous sheet was prepared by the same procedures as in Example 1. An aqueous solution of sodium sulfate, a resin, trimethyl glycine and glycerin shown in Table 7 each at a content shown in Table 7 was prepared by properly adding ion exchanged water. 100 g weight of the fibrous sheet was impregnated with 250 g of the aqueous solution. Water disintegratability and wet strength were measured for the thus obtained water-disintegratable cleaning sheet. The measuring method was identical with that in Example 1.

The results are shown in Table 7.

TABLE 7

| | Example 15 | Example 16 | Example 17 | Example 18 | Example 19 |
|---|---|---|---|---|---|
| Amount of fiber (g/m$^2$) | 50 | 50 | 50 | 50 | 50 |
| Kind of copolymer | *1 | *1 | *1 | *1 | *1 |
| Copolymer (wt %) | 0.05 | 1.00 | 5.00 | 0.00 | 7.00 |
| Sodium sulfate (wt %) | 3.0 | 30 | 3.0 | 3.0 | 3.0 |
| Trimethyl glycine (wt %) | 4.0 | 4.0 | 4.0 | 4.0 | 4.0 |
| Glycerin (wt %) | 70 | 7.0 | 7.0 | 7.0 | 7.0 |
| Wet strength:MD (g/25 mm) | 750 | 1080 | 1220 | 670 | 1300 |
| Wet strength:CD (g/25 mm) | 160 | 228 | 253 | 144 | 260 |
| Water disintegratability (sec) | 19 | 41 | 53 | 17 | 65 |

| | Example 20 | Example 21 | Example 22 | Example 23 |
|---|---|---|---|---|
| Amount of fiber (g/m$^2$) | 50 | 50 | 50 | 50 |
| Kind of copolymer | *2 | *2 | *2 | *2 |
| Copolymer (wt %) | 0.05 | 1.00 | 5.00 | 7.00 |
| Sodium sulfate (wt %) | 3.0 | 3.0 | 3.0 | 3.0 |
| Trimethyl glycine (wt %) | 4.0 | 4.0 | 4.0 | 4.0 |
| Glycerin (wt %) | 7.0 | 7.0 | 7.0 | 7.0 |
| Wet strength:MD (g/25 mm) | 804 | 1132 | 1180 | 1250 |
| Wet strength:CD (g/25 mm) | 172 | 239 | 245 | 255 |
| Water disintegratability (sec) | 20 | 32 | 48 | 60 |

*1 Partial sodium salt of (meth)acrylic acid(ester)-maleic acid copolymer

*2 Partial calcium salt of α-olefin fumaric acid copolymer

What is claimed is:

1. A water-disintegratable cleaning sheet comprising:

a fibrous sheet comprising water-dispersible fibers, having incorporated therein, a binder comprising alkylcellulose; and a monovalent organic or inorganic salt as an electrolyte, and at least one compound selected from the group consisting of:

a) copolymers of polymerizable acid anhydride compounds and other compounds; and b) amino acid derivatives.

2. The water-disintegratable cleaning sheet as defined in claim 1, wherein the alkylcellulose is methylcellulose, the electrolyte is sodium sulfate, the copolymer is (meth)acrylic acid(ester)-maleic acid copolymer reacted with alkali metal hydroxides to saponify into partial sodium salt of carboxylic acid, and the amino acid derivative is trimethyl glycine.

3. The water-disintegratable cleaning sheet as defined in claim 2, wherein the copolymer is saponified to a degree of from 0.1 to 1.0.

4. The water-disintegratable cleaning sheet as defined in claim 3, wherein the basis weight of the fibrous sheet is from 20 to 100 g/m$^2$; the alkylcellulose is applied to the fibrous sheet at a coating amount of from 1 to 30 g based on 100 g of the fibers, and wherein the electrolyte, the copolymer and the amino acid derivative are incorporated into the fibrous sheet while being dissolved in an aqueous solution.

5. The water-disintegratable cleaning sheet as defined in claim 4, wherein the concentrations of the electrolyte, the copolymor and the amino acid derivative in the aqueous solution are from 0.5 to 10% by weight, from 0.05 to 5.0% by weight, and from 1 to 5% by weight, respectively.

* * * * *